US007950926B2

(12) United States Patent
Hetzer et al.

(10) Patent No.: US 7,950,926 B2
(45) Date of Patent: May 31, 2011

(54) ELECTRICAL CONTACT ARRANGEMENT FOR TELECOMMUNICATIONS AND DATA SYSTEMS TECHNOLOGY

(75) Inventors: Ulrich Hetzer, Berlin (DE); Frank Mossner, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/522,950

(22) PCT Filed: Dec. 13, 2007

(86) PCT No.: PCT/EP2007/010932

§ 371 (c)(1),
(2), (4) Date: Jul. 13, 2009

(87) PCT Pub. No.: WO2008/086864

PCT Pub. Date: Jul. 24, 2008

(65) Prior Publication Data

US 2010/0041250 A1 Feb. 18, 2010

(30) Foreign Application Priority Data

Jan. 18, 2007 (DE) ..... 10 2007 002 768

(51) Int. Cl.
*H01R 12/00* (2006.01)

(52) U.S. Cl. ..... 439/59

(58) Field of Classification Search ..... 439/59, 439/676, 557, 344, 941, 258; 361/766
See application file for complete search history.

(56) References Cited

U.S. PATENT DOCUMENTS

| | | | | |
|---|---|---|---|---|
| 4,720,269 | A | 1/1988 | Haskins et al. | |
| 5,479,320 | A | 12/1995 | Estes et al. | |
| 6,089,894 | A | 7/2000 | Fletcher | |
| 6,155,882 | A | 12/2000 | Wu | |
| 6,196,880 | B1 * | 3/2001 | Goodrich et al. | 439/676 |
| 6,280,254 | B1 | 8/2001 | Wu et al. | |
| 6,350,158 | B1 * | 2/2002 | Arnett et al. | 439/676 |
| 6,416,343 | B1 | 7/2002 | Chio | |
| 6,953,362 | B2 | 10/2005 | Mossner et al. | |
| 6,981,887 | B1 | 1/2006 | Mese et al. | |
| 7,040,933 | B1 | 5/2006 | Ma | |
| 7,186,149 | B2 * | 3/2007 | Hashim | 439/676 |
| 7,252,554 | B2 | 8/2007 | Caveney et al. | |
| 7,265,300 | B2 * | 9/2007 | Adriaenssens et al. | 174/258 |
| 7,320,624 | B2 * | 1/2008 | Hashim et al. | 439/676 |
| 7,682,203 | B1 * | 3/2010 | Pharney et al. | 439/676 |
| 7,798,866 | B2 | 9/2010 | Hetzer et al. | |

(Continued)

FOREIGN PATENT DOCUMENTS

DE 200 15 772 12/2000

(Continued)

*Primary Examiner* — Jean F Duverne
(74) *Attorney, Agent, or Firm* — Merchant & Gould P.C.

(57) ABSTRACT

The invention relates to an electrical contact arrangement (1) for telecommunications and data systems technology, comprising at least one electrical contact (K1) and a printed circuit board (2), the contact (K1) being connected to the printed circuit board (2) both electrically and mechanically. The contact (K1) comprises a contact region (7) on which an electrical contact for contacting the counter-contact is generated. The distance (L el) between the contact region (7) of the contact (K1, K8) and the electrical contact point (K8) for contacting the printed circuit board (2) is shorter than the distance (L mech) between the contact region (7) of the contact (K1, K8) and the mechanical contact point (9) for contacting the printed circuit board (2).

20 Claims, 3 Drawing Sheets

U.S. PATENT DOCUMENTS

| | | | | |
|---|---|---|---|---|
| 2002/0160662 | A1* | 10/2002 | Arnett et al. | 439/676 |
| 2002/0177366 | A1* | 11/2002 | Hyland | 439/676 |
| 2003/0129880 | A1* | 7/2003 | Arnett et al. | 439/676 |
| 2004/0184247 | A1 | 9/2004 | Adriaenssens | |
| 2004/0253844 | A1 | 12/2004 | Mendenhall | |
| 2006/0014410 | A1 | 1/2006 | Caveney | |
| 2007/0254529 | A1* | 11/2007 | Pepe et al. | 439/676 |
| 2010/0003847 | A1 | 1/2010 | Hetzer et al. | |
| 2010/0075530 | A1 | 3/2010 | Hetzer et al. | |

FOREIGN PATENT DOCUMENTS

| | | |
|---|---|---|
| DE | 102 59 277 | 7/2004 |
| DE | 10 2004 041 207 | 3/2006 |
| DE | 20 2005 020842 | 9/2006 |
| EP | 1 312 137 | 5/2005 |
| FR | 2 761 819 | 10/1998 |

* cited by examiner

ELECTRICAL CONTACT ARRANGEMENT FOR TELECOMMUNICATIONS AND DATA SYSTEMS TECHNOLOGY

This application is a National Stage Application of PCT/EP2007/010932, filed 13 Dec. 2007, which claims benefit of Serial No. 10 2007 002 768.2, filed 18 Jan. 2007 in Germany and which applications are incorporated herein by reference. To the

BACKGROUND

Such a contact arrangement is known, for example, by the RF contacts of an RJ45 socket. These RF contacts are mechanically and electrically connected to a printed circuit board. In this case, the RF contacts are sprung in order to produce a sufficiently effective electrical contact despite certain tolerances of the sockets and plugs. For reasons of electrical transmission properties, it is endeavored to select the contacts to be as short as possible. On the other hand, the contacts need to be sufficiently long such that they spring to a sufficient extent to compensate for tolerances and to produce sufficient contact force.

Against the background of this prior art, the invention is based on the technical problem of providing an electrical contact arrangement which has good electrical transmission properties and nevertheless is sufficiently sprung.

SUMMARY

In this regard, the electrical contact arrangement for telecommunications and data technology comprises at least one electrical contact and a printed circuit board, the contact being connected both electrically and mechanically to the printed circuit board, the contact having a contact region on which an electrical contact to a mating contact is produced, the length between the contact region of the contact and the electrical contact point with the printed circuit board being shorter than the length between the contact region of the contact and the mechanical contact point with the printed circuit board. As a result, decoupling between the electrical and the mechanical properties of the contact is achieved such that a sufficient spring effect can be set without the electrical transmission properties being substantially altered. The mechanical contact point is in this case achieved either by a fixed connection by means of adhesive bonding, soldering or the like or else by the contact being fixedly clamped against the printed circuit board.

Preferably, the contact between the electrical contact point and the mechanical contact point is bent back from the printed circuit board.

In a further preferred embodiment, in addition, a further electrical contact point to the printed circuit board is formed via the mechanical contact point. In addition to reasons of redundancy, this further contact point can be used for charging compensation capacitances.

In a further preferred embodiment, the electrical contact is pressed against the printed circuit board under prestress via a comb element. This ensures a sufficient contact force.

In a further preferred embodiment, the printed circuit board is mounted such that it can move in relation to a housing part via a spring-elastic element. This makes it possible for a further part of the required excursion to be distributed and for the mechanical length of the contact to be selected such that it is correspondingly shorter. The spring-elastic element is in this case preferably in the form of an elastomer, rubber element or in the form of a spring, preferably a metal spring.

In a further preferred embodiment, the printed circuit board is mounted fixedly in a second housing part, the second housing part being connected to the first housing part such that it can pivot. This prevents contacts, which are mounted, for example, in the second housing part and are connected via soldered joints to the printed circuit board, from being moved in relation to the printed circuit board as a result of the movement of the printed circuit board, which could otherwise result in the soldered joints being torn away.

In a further preferred embodiment, the second housing part is designed to have at least one receptacle for a cylinder of the first housing part, which receptacles then together form a pivot-bearing arrangement.

In a further preferred embodiment, the electrical contact arrangement is in the form of an RJ45 contact arrangement, at least the two outer contacts being designed to have a mechanical length which is longer than the electrical length. This results in the two outer contacts not being damaged in the case of an RJ11 plug inadvertently being plugged in, since the RJ11 plug does not have any contacts there, but lower-lying housing parts, such that, in the prior art, damage to the contacts often arises.

BRIEF DESCRIPTION OF THE DRAWINGS

The invention will be explained in more detail below with reference to a preferred exemplary embodiment. In the figures.

DETAILED DESCRIPTION

Figure 1:
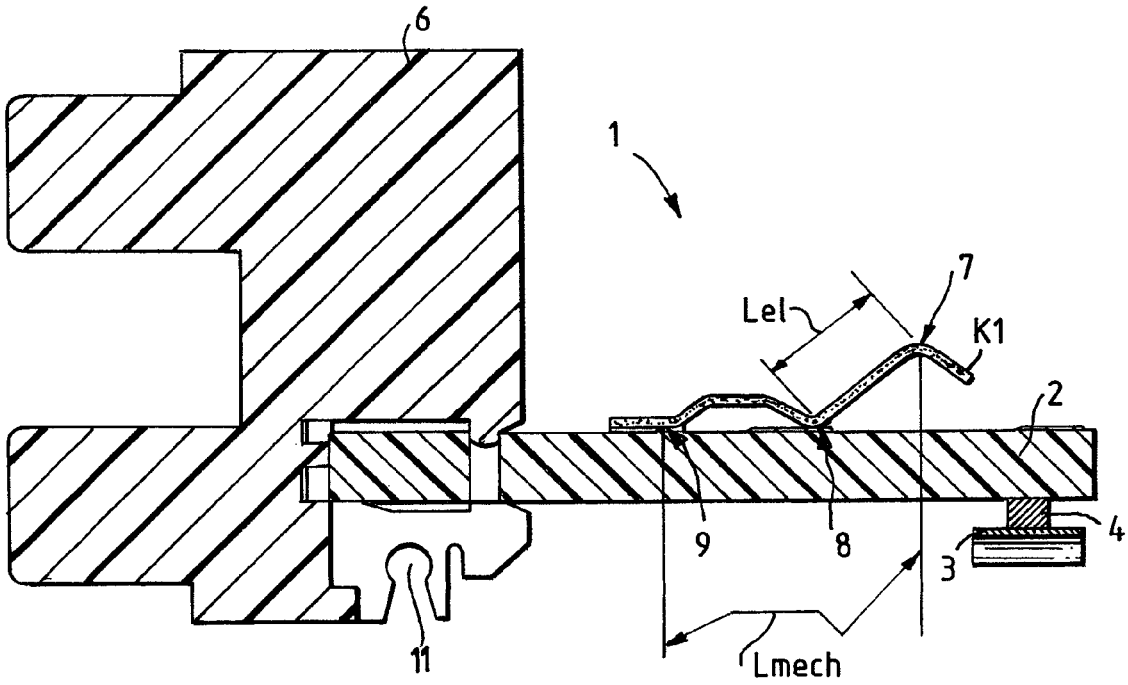
FIG. 1 shows a cross-sectional illustration of an electrical contact arrangement.

FIG. 1 illustrates an electrical contact arrangement 1 comprising at least one electrical contact K1, a printed circuit board 2, a contact-pressure spring 3 having an intermediate piece 4 and a second housing part 6. The electrical contact K1 has a contact region 7, an electrical contact point 8 with the printed circuit board 2 and a mechanical contact point 9 with the printed circuit board 2. The printed circuit board 2 is mounted fixedly in the second housing part 6. The printed circuit board 2 is mounted such that it can move in relation to a first housing part 5 (see FIG. 3) and provided with a spring prestress via the contact-pressure spring 3. The second housing part 6 is in this case designed to have a receptacle 11, which accommodates a cylinder of the first housing part 5.

At the mechanical contact point 9, the contact K1 is fixedly connected to the printed circuit board 2, whereas, at the electrical contact point 8, the contact K1 is only pressed against the printed circuit board 2 in a sprung manner. The length L el between the contact region 7 of the contact K1 and the electrical contact point 8 with the printed circuit board 2 is in this case shorter than the length L mech between the contact region 7 and the contact K1 and the mechanical contact point 9 with the printed circuit board 2. If a mating contact, for example in the form of a plug, is now inserted into the first housing part, it generally comes into contact with the contact region 7 of the contact K1 and produces an electrical connection. Owing to the prestress of the electrical contact K1 by a comb element (not illustrated) and the prestress of the printed circuit board 2 by the contact-pressure spring 3, it is ensured here that the contact force between the mating contact and the contact region 7 is sufficiently great if the plug otherwise presses the contact K1 only slightly downwards in the direction of the printed circuit board 2 owing to tolerances. If, however, owing to tolerances or an incorrect plug being incorrectly inserted, the contact K1 is pressed by the plug to a considerable extent downwards in the direction of the printed circuit board 2, this can firstly be compensated for by virtue of the fact that the printed circuit board 2 is pressed downwards counter to the contact-pressure spring 3 and, secondly, the contact K1 absorbs this force by deforming the contact K1 between the electrical contact point 8 and the mechanical contact point 9. The contact-pressure spring 3 and the contact K1 are in this case designed in terms of spring constants such that, at first, the excursion is primarily compensated for by the contact-pressure spring 3. The electrical contact point 8 therefore remains largely uninfluenced and the tolerances of the plug can be compensated for without the quality of the contact to the printed circuit board 2 being influenced. However, if an incorrect plug has been inserted which for example, has a low-lying housing part instead of a mating contact, the contact K1 absorbs this additional excursion by sprung deformation without being destroyed. This results in the electrical contact point 8 of the contact K1 being pushed in the direction of the mechanical contact point 9. In an extreme case, this may result in the electrical contact to the printed circuit board 2 being interrupted, which is not critical, however, since an incorrect plug in any case should not or does not need to come into electrical contact. Otherwise, this would be significant owing to a sufficiently large dimensioning of the contact pad on the printed circuit board 2. Since the electrical transmission properties are largely determined by the electrical length L el, good electrical and mechanical properties are thus achieved at the same time. The part of the contact K1 between the electrical contact point 8 and the mechanical contact point 9 can influence, if need be, the electrical transmission response by means of capacitive couplings.

Figure 2:
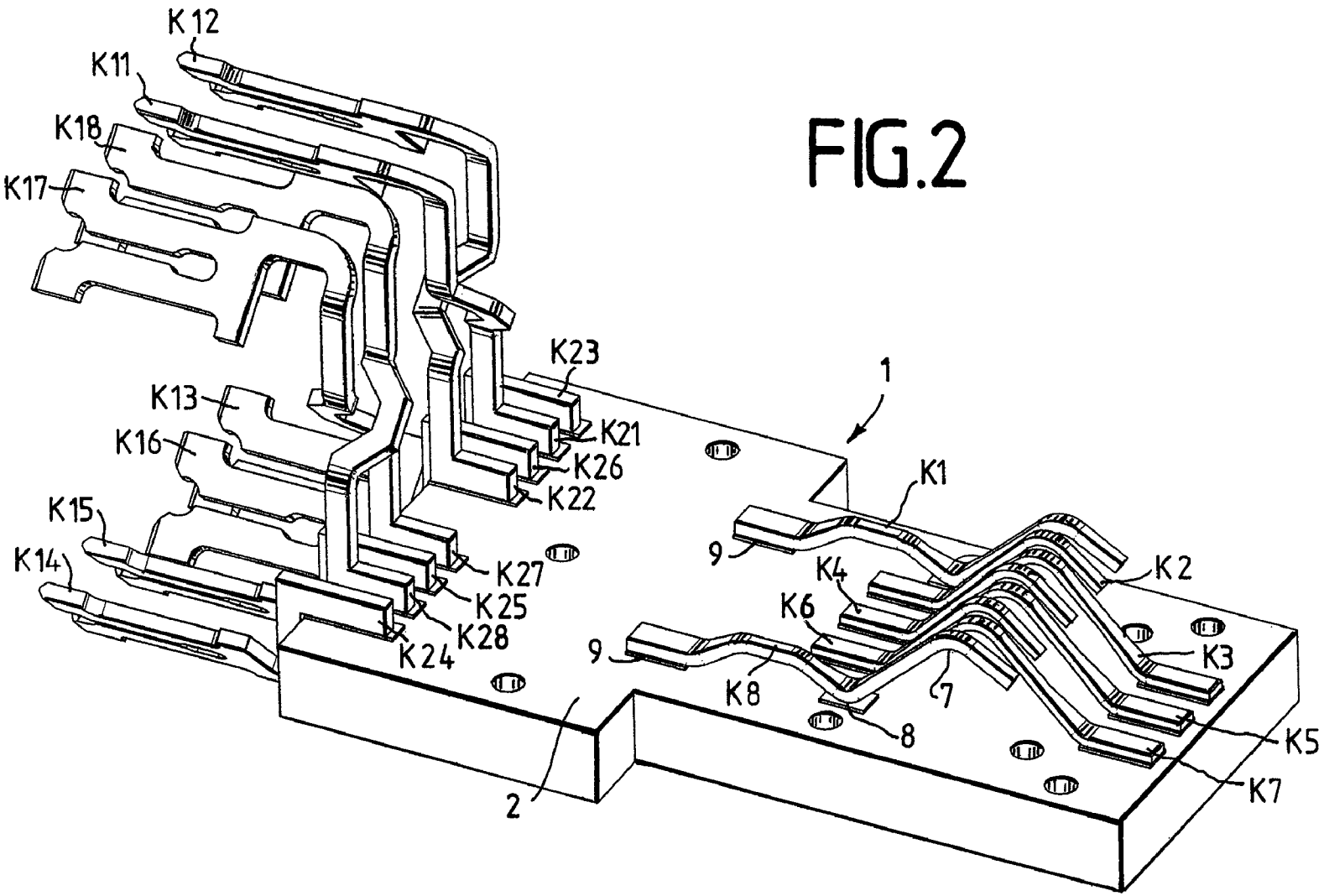
FIG. 2 shows a perspective illustration of an RJ45 contact arrangement.

FIG. 2 illustrates the electrical contact arrangement 1 for an RJ45 socket, this RJ45 socket having eight contacts K1 to K8, which are in the form of RF contacts. In this case, the two outer contacts K1 and K8 are designed to have a longer mechanical length L mech since these two contacts K1 and K8 are at particular risk from an RJ11 plug. As can be seen from the figure, the capacitive coupling of the contact parts between the electrical contact point 8 and the mechanical contact point 9 to other contacts K2 to K7 is low. Furthermore, it can be seen that the contacts K2 to K7 are bent alternately in opposite directions to one another in order to minimize the crosstalk in the contact region 7, since the capacitive coupling is low.

Eight insulation displacement contacts K11 to K18 are arranged on the opposite side of the printed circuit board 2 and are connected electrically to the contacts K1 to K8 via the printed circuit board 2. The insulation displacement contacts K11 to K18 are in this case connected to the printed circuit board 2 via SMD-like contacts K21 to K28. In this case, the connections between the contacts K11, K12, K17 and K18 and the contacts K21, K22, K27 and K28 is slightly longer than between the contacts K13 to K16 and K23 to K26. This results in more pronounced capacitive coupling which is compensated for by the connections being crossed over. In this case, the insulation displacement contacts K11, K12, K17, K18, which belong to the outer contact pairs K1, K2, K7, K8, are preferably the longer contacts in comparison with the contacts K13 to K16, since crosstalk between the outer contact pairs is generally less critical. In this case, express reference will once again be made to the fact that, for example, the contacts K11, K21 and K1 are electrically connected to one another. Likewise, the contacts K12, K22 and K2 etc., i.e. associated contacts, each have the same unit as the index. It can further be seen that the longitudinal direction of the insulation displacement contacts K11 to K18 is parallel to the SMD-like contacts K21 to K28 and the surface of the printed circuit board 2.

Figure 3:
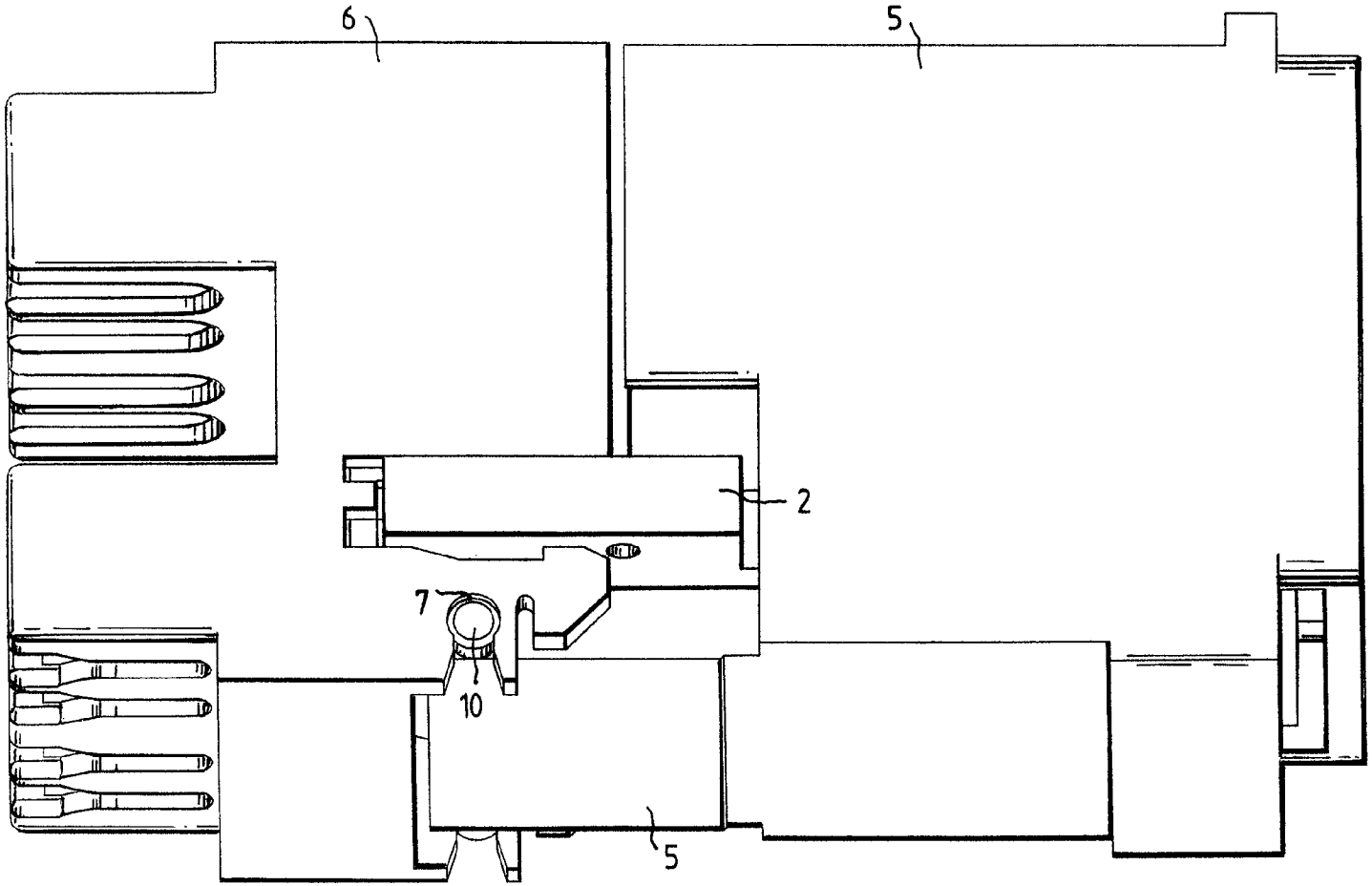
FIG. 3 shows a side view of a first and second housing part.

It can be seen in FIG. 3 how the first housing part 5 with a cylinder 10 engages in the receptacle 11 of the second housing part 6, with the result that a pivot-bearing arrangement is formed such that the printed circuit board 2 can move in relation to the first housing part 5 and, on the other hand, is rigid with respect to the second housing part 6.

LIST OF REFERENCE SYMBOLS

1 Contact arrangement
2 Printed circuit board
3 Contact-pressure spring
4 Intermediate piece
5 First housing part
6 Second housing part
7 Contact region
8 Electrical contact point
9 Mechanical contact point
10 Cylinder
11 Receptacle
K1-K8 contacts
K11-K18 Insulation displacement contacts
K21-K28 SMD-like contacts
L el Electrical length
L mech Mechanical length

The invention claimed is:

1. An electrical contact arrangement for telecommunications and data technology, comprising:

at least a first electrical contact and a printed circuit board, the first electrical contact being connected electrically to the printed circuit board at an electrical contact point and mechanically to the printed circuit board at a mechanical contact point, the first electrical contact having a contact region at which the first electrical contact electrically connects to a mating contact, the electrical contact point being located between the mechanical contact point and the contact region, wherein a length between the contact region of the first electrical contact and the electrical contact point with the printed circuit board is shorter than a length between the contact region of the first electrical contact and the mechanical contact point with the printed circuit board.

2. The electrical contact arrangement as claimed in claim 1, wherein a portion of the first electrical contact extending between the electrical contact point and the mechanical contact point is bent back from the printed circuit board.

3. The electrical contact arrangement as claimed in claim 1, wherein, in addition, a further electrical contact point to the printed circuit board is formed via the mechanical contact point.

4. The electrical contact arrangement as claimed in claim 1, wherein the first electrical contact is pressed against the printed circuit board under prestress via a comb element.

5. The electrical contact arrangement as claimed in claim 1, wherein the printed circuit board is mounted to a housing part such that the printed circuit board is configured to move in relation to the housing part via a spring-elastic element.

6. The electrical contact arrangement as claimed in claim 5, wherein the printed circuit board is mounted fixedly in a second housing part, the second housing part being pivotally connected to the first housing part.

7. The electrical contact arrangement as claimed in claim 6, wherein the second housing part is designed to have at least one receptacle for a cylinder of the first housing part.

8. The electrical contact arrangement as claimed in claim 1, wherein the electrical contact arrangement is in the form of an RJ45 contact arrangement, wherein at least two outer contacts of the RJ45 contact arrangement are designed to have a mechanical length which is longer than an electrical length.

9. The electrical contact arrangement as claimed in claim 1, further comprising a first insulation displacement contact mounted to another side of the printed circuit board, the first insulation displacement contact being connected electrically to the first electrical contact.

10. The electrical contact arrangement as claimed in claim 1, further comprising:

a first housing part to which the printed circuit board is mounted, the first housing part defining a receptacle; and a second housing part including a pin that is configured to mount in the receptacle to pivotally connect the second housing part to the first housing part, the second housing part at least partially covering the first electrical contact.

11. The electrical contact arrangement as claimed in claim 10, wherein the printed circuit board is connected to a contact pressure spring, which prestresses the printed circuit board.

12. The electrical contact arrangement as claimed in claim 10, wherein the first housing part houses at least one insulation displacement contact that is coupled to the first electrical contact.

13. The electrical contact arrangement as claimed in claim 12, wherein the first housing part houses two rows of insulation displacement contacts that are mounted to the printed circuit board.

14. The electrical contact arrangement as claimed in claim 10, wherein the receptacle of the first housing part is located below a bottom side of the printed circuit board and the first electrical contact is mounted to a top side of the printed circuit board.

15. The electrical contact arrangement as claimed in claim 1, further comprising:

a second electrical contact mounted to the printed circuit board, the second electrical contact being connected electrically to the printed circuit board at a second electrical contact point and mechanically to the printed circuit board at a second mechanical contact point, the second electrical contact having a second contact region at which the second electrical contact electrically connects to a mating contact, the second electrical contact point being located between the second mechanical contact point and the second contact region, wherein a length between the contact region of the second electrical contact and the second electrical contact point with the printed circuit board is shorter than a length between the second contact region of the second electrical contact and the second mechanical contact point with the printed circuit board.

16. The electrical contact arrangement as claimed in claim 15, further comprising a plurality of additional electrical contacts mounted to the printed circuit board between the first and second electrical contacts.

17. The electrical contact arrangement as claimed in claim 16, wherein a length between an electrical contact point and a contact region of each additional electrical contact is the same length as a mechanical contact point and the contact region of each additional electrical contact.

18. The electrical contact arrangement as claimed in claim 16, wherein the additional electrical contacts are bent alternately in opposite directions to one another.

19. The electrical contact arrangement as claimed in claim 16, wherein mechanical contact points of certain ones of the additional electrical contacts are generally aligned along the printed circuit board.

20. The electrical contact arrangement as claimed in claim 19, wherein the mechanical contact points of the certain ones of the additional electrical contacts are generally aligned with the electrical contact points of the first and second electrical contacts.

* * * * *

UNITED STATES PATENT AND TRADEMARK OFFICE

CERTIFICATE OF CORRECTION

PATENT NO. : 7,950,926 B2
APPLICATION NO. : 12/522950
DATED : May 31, 2011
INVENTOR(S) : Hetzer et al.

It is certified that error appears in the above-identified patent and that said Letters Patent is hereby corrected as shown below:

Col. 1, line 9: "To the" should read --To the extent appropriate, a claim of priority is made to each of the above disclosed applications.--

Signed and Sealed this
Fourteenth Day of February, 2012

David J. Kappos

David J. Kappos
*Director of the United States Patent and Trademark Office*